US006234719B1

(12) United States Patent
Roynestad

(10) Patent No.: US 6,234,719 B1
(45) Date of Patent: May 22, 2001

(54) MOBILE COMBINED DRILLING AND PILING MACHINE AND METHOD FOR TUBULAR FOUNDATION WITH MACHINE

(75) Inventor: Tom Toralv Roynestad, Kvinesdal (NO)

(73) Assignee: Njal Underhaug (NO)

( * ) Notice: Subject to any disclaimer, the term of this patent is extended or adjusted under 35 U.S.C. 154(b) by 0 days.

(21) Appl. No.: 09/269,585

(22) PCT Filed: Sep. 26, 1996

(86) PCT No.: PCT/NO96/00228

§ 371 Date: Jul. 2, 1999

§ 102(e) Date: Jul. 2, 1999

(87) PCT Pub. No.: WO98/13555

PCT Pub. Date: Apr. 2, 1998

(51) Int. Cl.[7] ..... E02D 7/00; E21B 19/08

(52) U.S. Cl. ..... 405/232; 405/231; 405/244; 405/253; 175/162; 175/135; 173/1; 173/46; 173/147

(58) Field of Search ..... 405/231–233, 405/229, 244, 245, 249, 253, 257, 303; 175/135, 162, 171; 173/1, 44, 46, 147, 184–188, 163–166

(56) References Cited

U.S. PATENT DOCUMENTS

| | | | | |
|---|---|---|---|---|
| 108,814 | * | 11/1870 | Moseley | 405/222 |
| 715,362 | * | 12/1902 | Etheridge | 52/721.2 |
| 3,705,634 | * | 12/1972 | Casagrande | 175/122 |
| 3,728,862 | * | 4/1973 | Meredith | 405/285 |
| 3,729,057 | * | 4/1973 | Werner | 175/262 |
| 3,833,072 | * | 9/1974 | Back | 175/85 |
| 3,869,003 | * | 3/1975 | Yamada et al. | 175/171 |
| 4,195,698 | * | 4/1980 | Nakagawasai | 173/147 X |
| 4,416,339 | * | 11/1983 | Baker et al. | 175/61 |
| 4,621,950 | * | 11/1986 | Kinnan | 405/231 |
| 4,702,325 | | 10/1987 | Hipp . | |
| 4,860,837 | * | 8/1989 | Robert | 175/162 X |
| 5,018,905 | * | 5/1991 | Kinder | 405/232 X |
| 5,066,168 | * | 11/1991 | Holderman | 405/249 |
| 5,125,462 | * | 6/1992 | Hesse | 175/19 |
| 5,375,664 | * | 12/1994 | McDowell et al. | 173/1 |
| 5,516,237 | * | 5/1996 | Hebant | 405/233 |
| 5,544,978 | * | 8/1996 | Albers | 405/232 |
| 5,707,180 | * | 1/1998 | Vickars et al. | 405/233 |
| 5,944,452 | * | 8/1999 | Reinert, Sr. | 405/232 |

FOREIGN PATENT DOCUMENTS

| | | |
|---|---|---|
| 1382563 | 2/1975 | (DE) . |
| 4010955 A1 | 11/1990 | (DE) . |
| 167577 B1 | 11/1993 | (DK) . |
| 0 102 322 | 7/1983 | (EP) . |
| 0 392 310 A3 | 10/1990 | (EP) . |
| 0 329 309 B1 | 8/1994 | (EP) . |
| 3-21719 | 1/1991 | (JP) . |
| 140835 | 8/1979 | (NO) . |

* cited by examiner

*Primary Examiner*—David Bagnell
*Assistant Examiner*—Jong-Suk Lee
(74) *Attorney, Agent, or Firm*—Mathews, Collins, Shepherd & Gould, P.A.

(57) ABSTRACT

A method in or relating to piling of e.g. tubular bases which are placed and, possibly, casted within a hole drilled out in earth mass in ground or the like is described. One uses a generally known drilling rig, in which a bit is assigned a drilling hammer, and drills a hold having a depth approximately corresponding to the base pipe. If there exists a need for piling, the drill string is swung aside, away from the hole, after having been pulled up, and one or, possibly, a plurality of piles is/are rammed down with a starting point at the bottom level of the bore hole. In order to drive the pile(s) down, the drilling hammer of the drilling rig is used.

4 Claims, 8 Drawing Sheets

MOBILE COMBINED DRILLING AND PILING MACHINE AND METHOD FOR TUBULAR FOUNDATION WITH MACHINE

BACKGROUND OF THE INVENTION

1. Field of the Invention

The present invention relates to a method for piling in connection with vertical or substantially vertical bore holes for base pipes drilled out into the earth, said base pipes, possibly, can be casted firmly to the surrounding hole wall. Likewise, the invention relates to devices in or relating to Aa combined drilling and piling machine or rig for the above-mentioned general objects.

2. Related Art

In order to attach a mounting plate for anchorage of a mast, it has previously been known to drill a hole and, thereafter, to lower a base pipe for the mounting plate, and it has also been known to attach such a mounting plate to a pile.

In order to make the base of the mounting plate sufficiently stable, the upper portion thereof should be constituted of a base pipe, because known piles/pile pipes do not exhibit the sufficient cross-sectional diameter.

According to prior art techniques, the piles are driven down by means of a special piling machine. It represents an obvious disadvantage having to use two separate working machines, a drilling machine and a piling machine, for carrying out two mutually associated working operations.

SUMMARY OF THE INVENTION

As known piles are cheaper than base pipes, simultaneously as piles are less expensive to install, one of the objects of the present invention is to mount piles in the continuation of a base pipe in order to prevent the base pipe from sinking.

Therefore, an essential object of the present invention has been to simplify the piling operation to a substantial degree.

By means of a drilling rig in which the bit, as known per se, is assigned a drilling hammer in order to make the drilling more efficient, a vertical or substantially vertical hole is predrilled. Prior to the positioning/casting of the base pipe, the piling is now effected, the pile with the lower end thereof being brought into contact with the lower end face of the predrilled hole, so that the piling is carried out from this lower positioned level only, as opposed to starting piling from ground level as with conventional piling.

Instead of using a separate piling machine, the piles are driven down using the same drilling rig as the one used during the drilling. During the piling, only the drilling hammer (without rotation) plus hydraulic feed pressure are used in order to ram the pile down.

The drill string with its bit is adapted to be swung about a vertical axis situated at a lateral distance from the drill string axis, so that the drill string may be swung aside of the predrilled hole, so that the pile can be lowered into the hole. During the drilling operations, a casing follows the bit/drilling hammer and becomes standing on the bottom of the predrilled hole. This casing will act as a guidance upon lowering the pile, which may be tubular in shape. The usually tubular pile may be centered in relation to the casing by means of a guiding means placed in the lower end of the casing.

During piling, when there exists a need for the reciprocating stroke-/impact-like movements only, but not for the bit, the lower end portion of the bit is externally covered by a chisel collar, whereafter the "drill string" (its drilling function being temporarily put out of operation) is swung back into alignment with the predrilled hole and the casing.

When the lower end of the pile pipe has reached firm ground, the casing is pulled up, and the base pipe is lowered and, possibly, is plastered firmly to surrounding hole wall.

An advantageous device for such a combined drilling and piling rig consists in installing an insignificantly narrower pipe than the casing between the latter and the drill string. During the pneumatically based drilling operation, pressurized air is pressed down, causing cuttings to be pressed up between the casing and said narrower, internal pipe surrounding the drill string. The insignificant difference of diameter between the casing and the narrower pipe makes the annulus therebetween small, thus requiring less capacity from the air compressor.

Base pipes in accordance with the invention are especially well suited as bases for masts, e.g. masts carrying lines for electrical traction current on railroads.

A combined drilling and piling rig according to the invention simplifies and makes more efficient building of bases positioned below ground level also in other respects in relation to prior art base positioning methods, the latter in the main consisting in digging-up, erecting a formwork and casting a base, possibly subsequent to ramming down pile(s) from ground level.

BRIEF DESCRIPTION OF THE DRAWINGS

An examplary embodiment of a rig according to the invention is further explained in the following, reference being made to the accommanying drawings, wherein.

DETAILED DESCRIPTION

Figure 1:
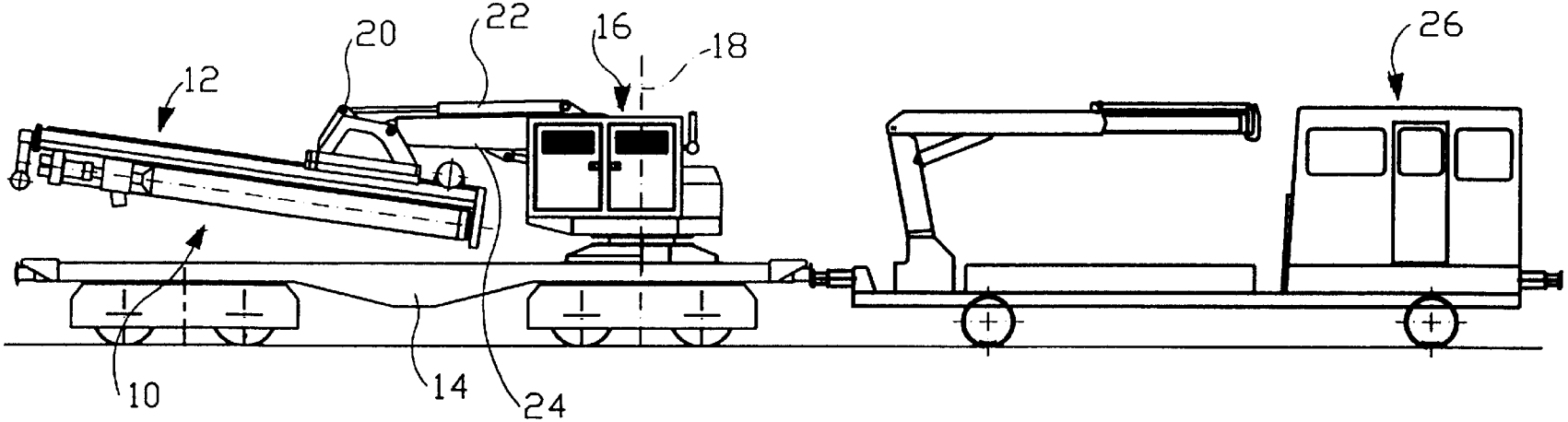
FIG. 1 shows a side elevational view of a combined drilling and piling rig in a transport position thereof, i.e. in a lying position on a carcase mounted on a rail-going vehicle.

A combined drilling and piling rig according to the invention is shown in transport position in FIG. 1, where the drill string 10 and a guiding column 12 parallel thereto are brought to take a slightly inclined position in order to lower their centre of gravity and to favour the stability of a carriage 14 on which the drilling and piling rig as well as a drive device 16 are installed. The drive device 16 is pivotally installed about a vertical axis 18.

Besides the ability to rotate about said vertical axis 18, it is obvious that the combination guiding column/drill string 10,12 also must be rotatable about at least one horizontal axis 20 in order to be aligned vertically or substantially vertically, in order to let the drilling or the piling, respectively, take place vertically or substantially vertically. To this end, a pressurized fluid cylinder 22 is arranged. Another, significantly larger pressurized fluid cylinder 24 provides for extension/withdrawal of the guiding column/drill string combination in relation to carriage 14 and a traction vehicle 26.

Figure 2:
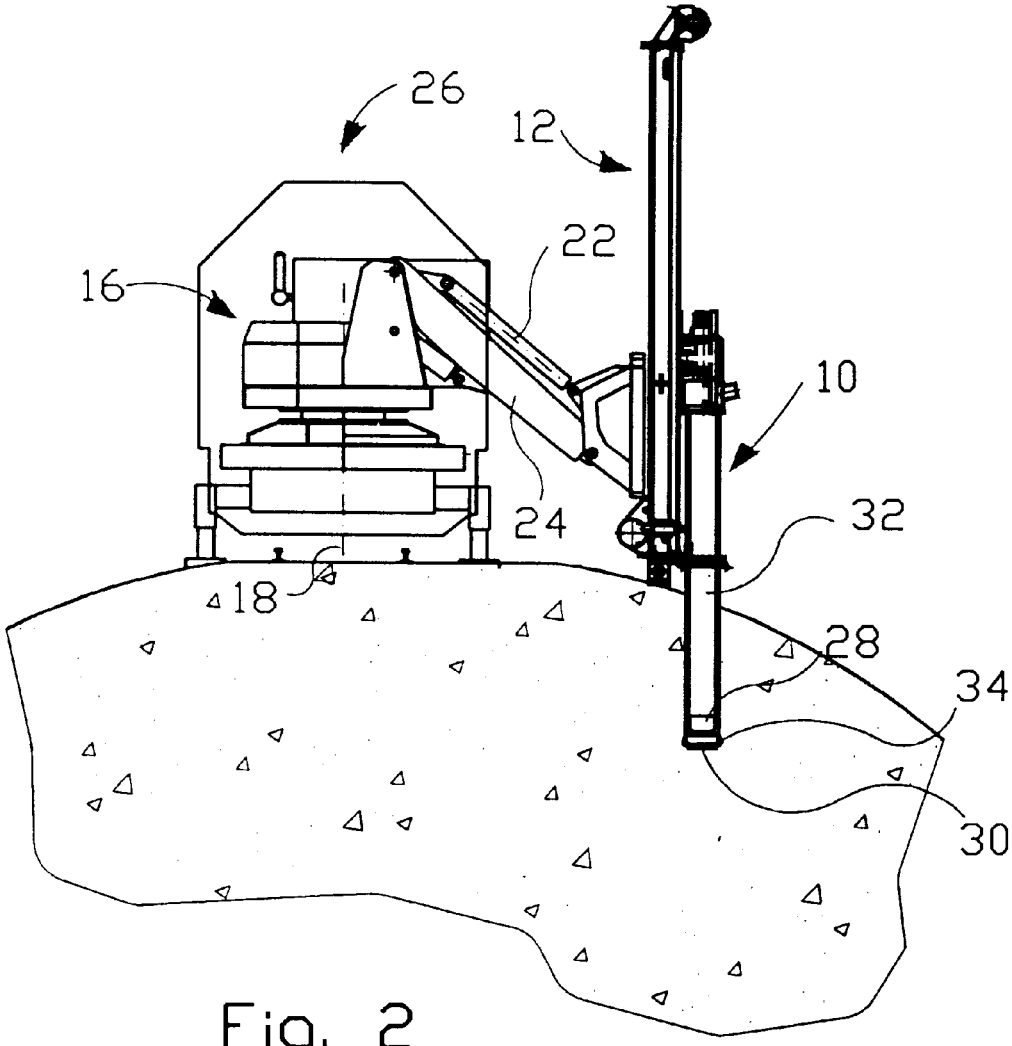
FIG. 2 shows an end view of the combined drilling and piling rig, which is operated from the vehicle, during the drilling down into an earth mass, where the bit has reached approximately down to the half of the depth desired to be achieved.
Figure 8:
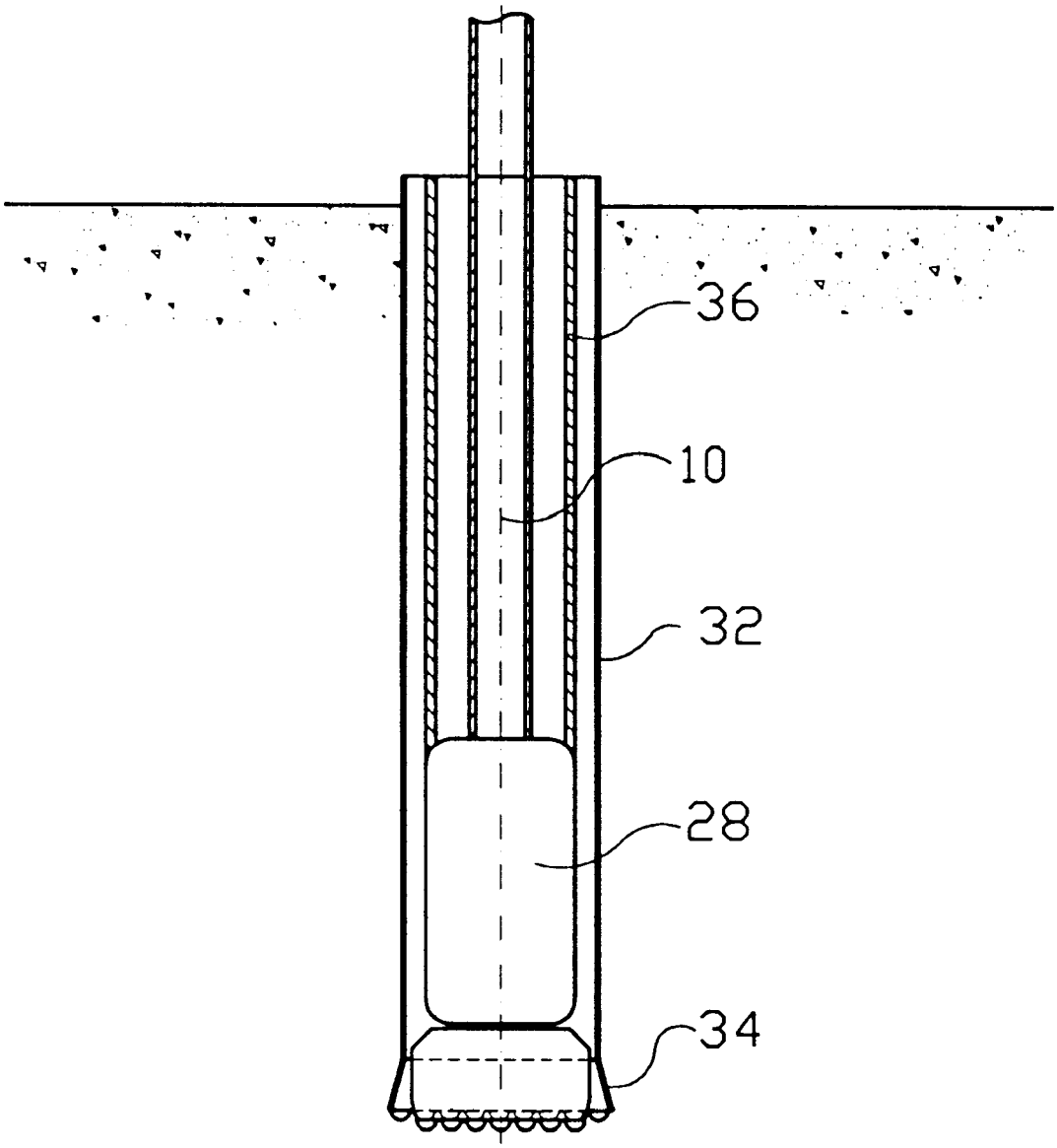
FIG. 8 shows the lower portion of the drill string during the drilling operation, the combined drilling means—the bit and the drilling hammer—being shown in an intermediate position between the starting drilling position and the final drilling position.
Figure 9:
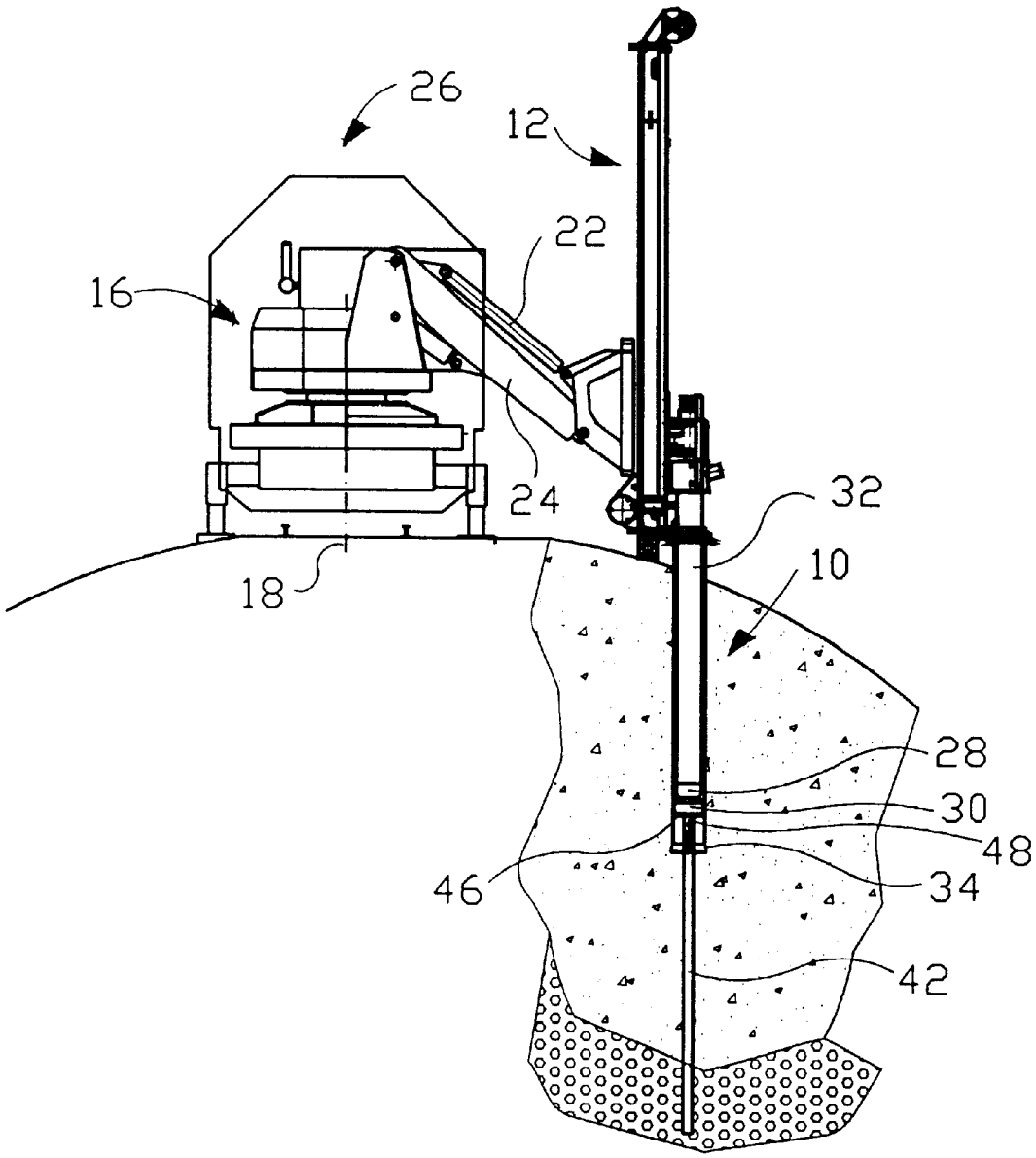
FIG. 9 corresponds to FIGS. 2 and 3, but shows the concluded piling operation using one pipe pile, the lower end portion thereof having penetrated down to rock or other firm ground, whereafter the casing is pulled up and removed. Now, in lieu of the withdrawn casing, the real pipe base (not shown) is now positioned, and, which possibly, is plastered firmly to the surrounding bore hole-defining wall of the ground.
Figure 10:
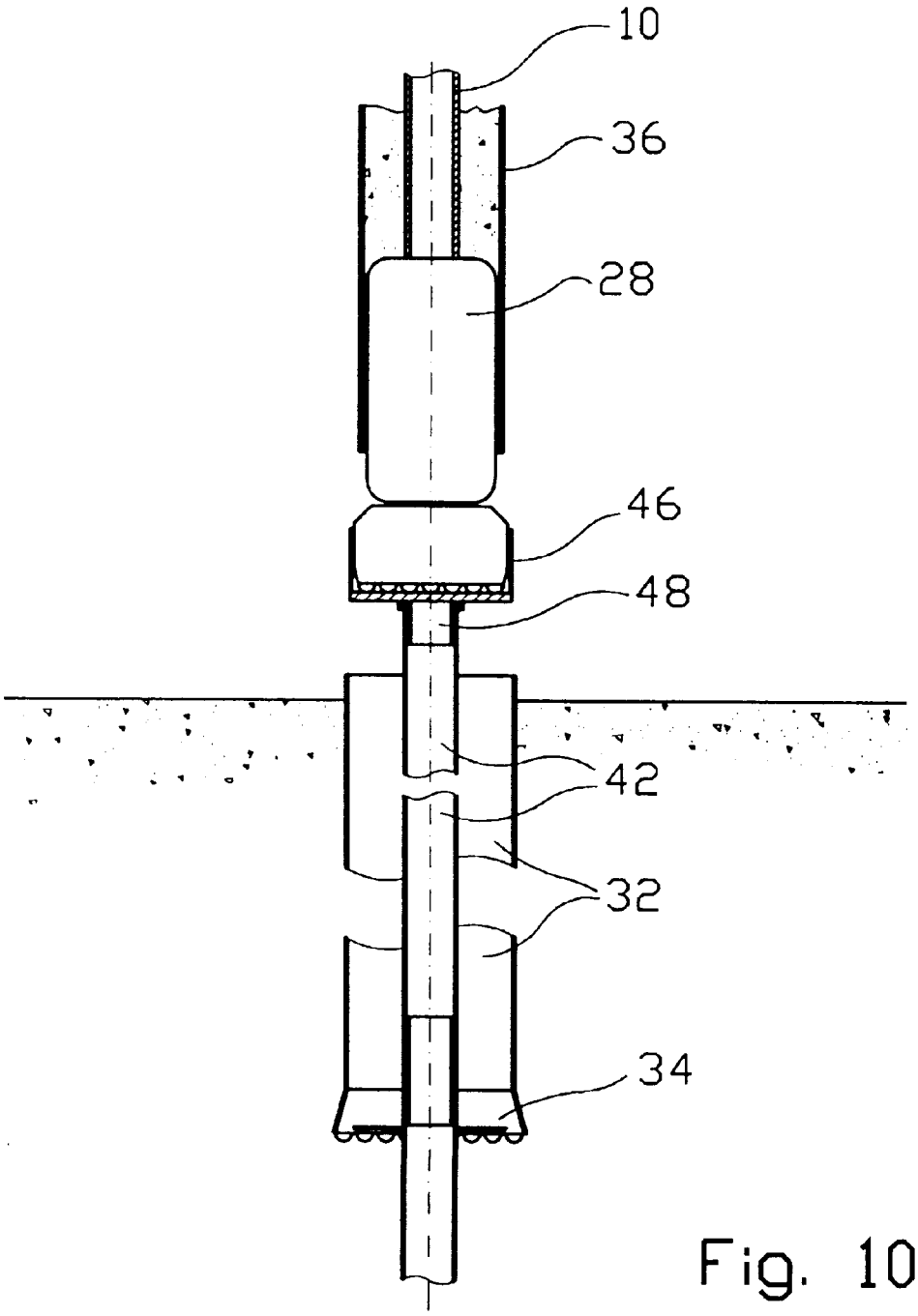
FIG. 10 shows an embodiment of a drill string wherein the bit has been put out of influencing/transferring rotational operation by means of said chisel collar, to which the first pile pipe or the sole pile pipe, respectively, is coupled, carrying a spreader. As in FIG. 8, the drilling hammer also here carries an upwardly directed pipe which is somewhat narrower than the casing. The intermediate annulus serves to allow an upwardly directed transport of cuttings from mass drilled out from the ground, pressurized air supplied thereto effecting the cuttings transport.

FIG. 2 shows the drilling rig brought into position for drilling which, in accordance with the figure, already has been carried out to approximately half the depth. The combined drilling means consists of a bit 30 and a drilling hammer 28 which, as known per se, carries out reciprocating stroke movements making the drilling more efficient. During the drilling, pressurized air from an air compressor is pressed down, causing cuttings to be pressed upwardly through the annulus between a casing 32 welded to a lower reamer ring 34, see particularly FIGS. 8 and 10, and a narrower pipe 36 surrounding the drill string 10. The annulus between the pipes 32 and 36 is made as small as possible, taking into account an efficient transport away of cuttings, reducing the requirement for air compressor capacity. When the drilling is finished and the drill string 10 is subjected to a vertically upwardly directed traction force, the casing 32 will remain in position within the predrilled hole in the ground, while the narrower pipe 36 follows the drilling hammer 28 up and out from the bore hole, until the drill string 10 takes the position shown in FIG. 3, between drilling and piling.

Figure 3:
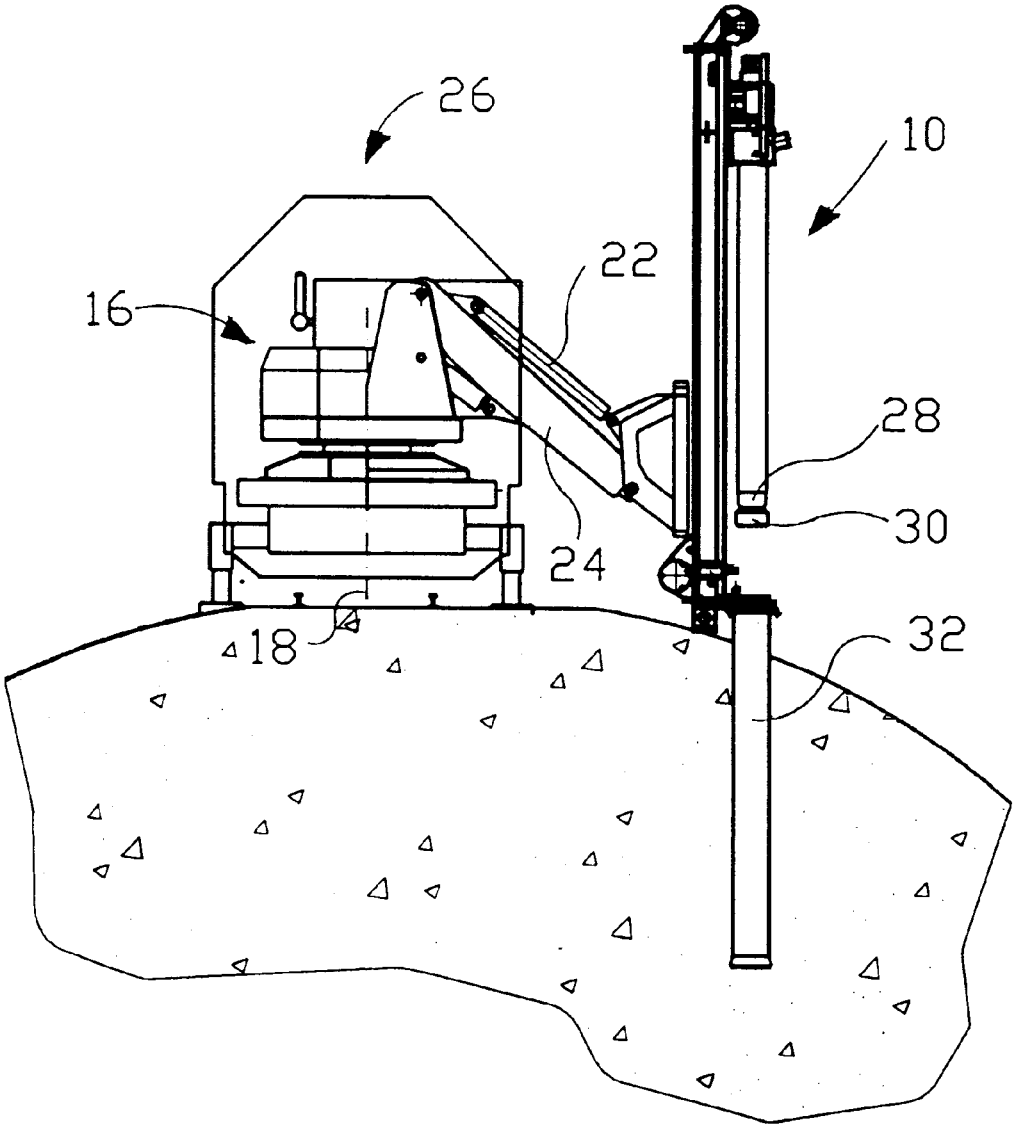
FIG. 3 corresponds to FIG. 2, but here the predrilled hole is completed, the drill string has been withdrawn upwardly therefrom, and the hole is lined with a casing which is brought to follow the bit/drilling hammer downwardly during drilling. Upon finished drilling, the bit may be adapted to collapse, so that it, together with the narrower drilling hammer, can be withdrawn out of the casing.
Figure 4:
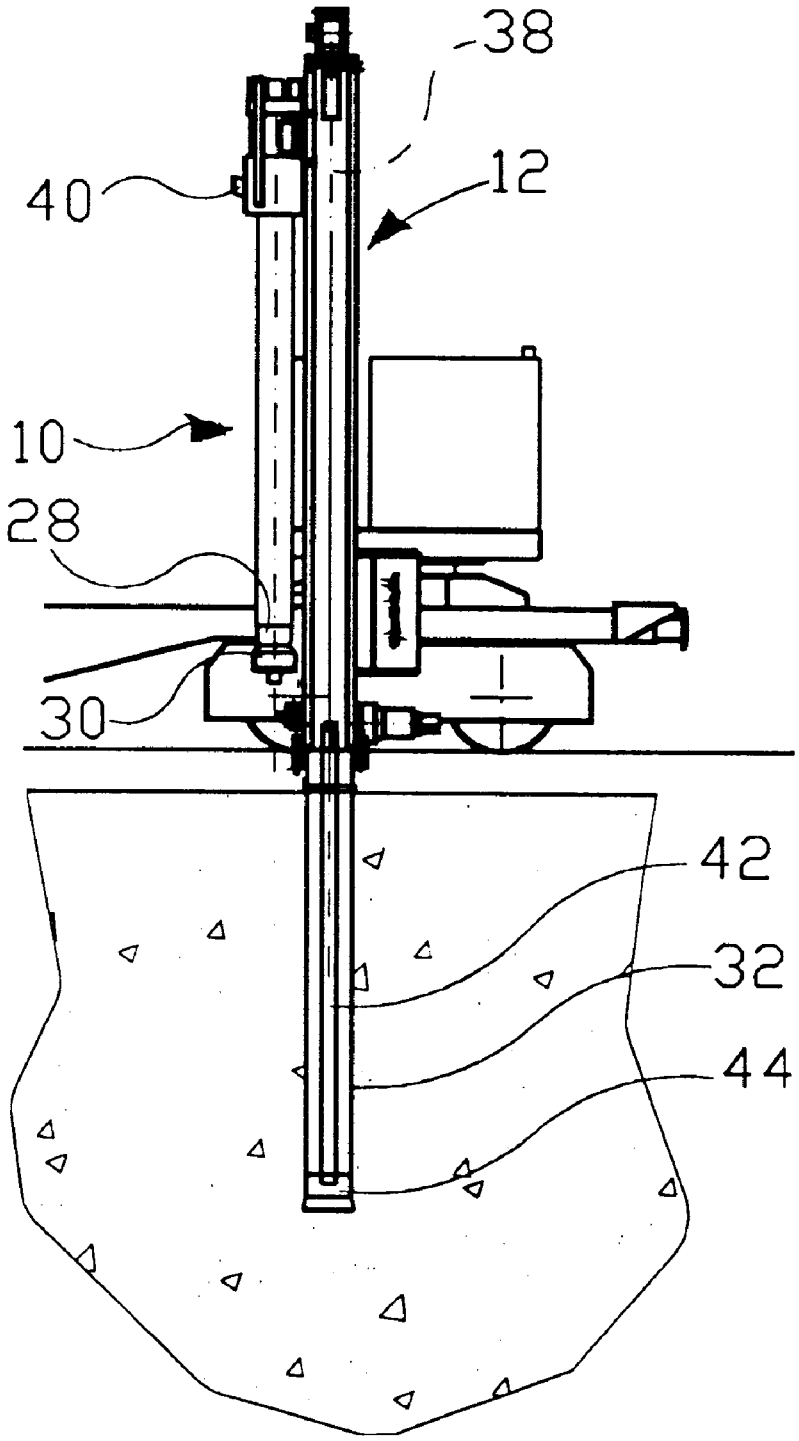
FIG. 4 corresponds to FIG. 3, but here the drawing plane forms an angle of 90° in relation to the drawing plane of FIG. 3, because the drill string has been swung away from the predrilled hole about a vertical rotational axis, the casing remaining in place, and a bottom centering means has provided guidance of a tubular pile during the lowering thereof into the predrilled hole.

With the drill string 10 hanging in the intermediate position shown in FIG. 3, the drill string 10 (according to FIG. 4) is swung about a vertical axis 38 (the axis of the guiding column 12). The drill string 10 may be supported in an upper head 40, with which it is attached to the guiding column 12 which, when the same is turned about its own axis, e.g. by means of a hydraulic cylinder (not shown), causes a lateral pivotal movement of the drill string 10 about the same axis 38, so that the drill string 10 is swung aside, of the bore hole, here represented through the casing 32, so that a pile pipe—first or sole pile 42—can be lowered into the bore hole until the lower end of the pile 42 hits and slides into a hole in a centering means 44, during which the casing 32 contributes to the guidance of the pile 42.

Figure 5:
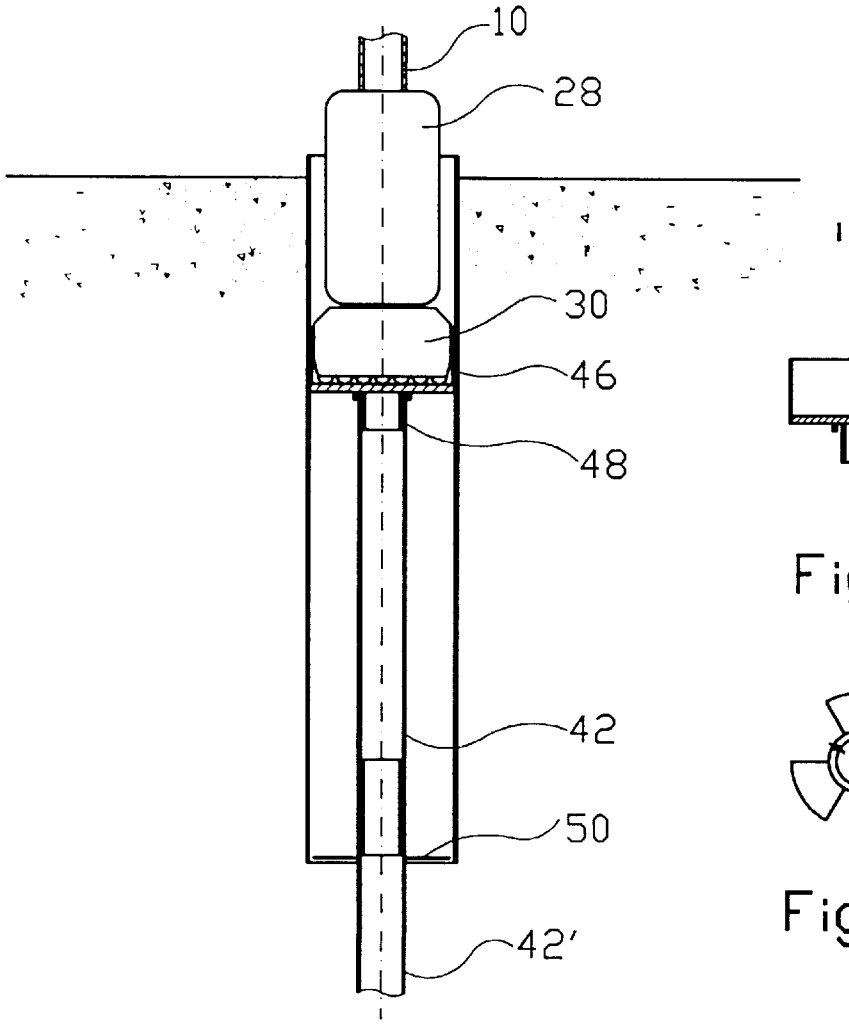
FIG. 5 shows, on a larger scale, a lower portion of the drill string carrying drilling hammer and underlying bit encapsulated within a chisel collar, the piling merely being carried out through the drilling hammer's reciprocating movements, without rotation. As opposed to FIG. 4 showing the use of one pile only for the subsequently positionable and, possibly, castable base pipe (not shown), FIG. 5 indicates interjointed piles.
Figure 6:
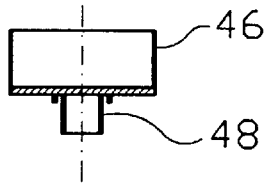
FIG. 6 shows a side elevational view of said chisel collar separately.
Figure 7:
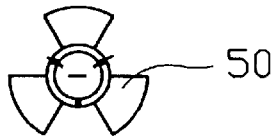
FIG. 7 shows a top plan view of a socalled spreader with which pile pipes according to the invention may be equipped at the area of the joint.

Thereafter, the bit 30 is provided with a chisel collar 46 having a guiding pin 48 to cooperate with the end portion of a pile pipe 42, see FIGS. 5 and 6, which also show a pile pipe joint having a socalled spreader 50, the circumferential shape thereof, preferably, corresponding to the one shown in FIG. 7.

What is claimed is:

1. A method for making a tubular foundation comprising the steps of:

drilling a substantially vertical bore hole in soil stratum in ground by a drilling and piling rig comprising a bit and a drilling hammer and being disposed on a pivotable support arm mounted on a motor vehicle, said bit being attached to a lower end of said drilling hammer;

lowering said tubular foundation into said vertical bore hole;

removing said drilling and piling rig from said substantially vertical bore hole, taking temporarily a position away from an upward imaginary extension of the bore hole;

lowering a pile down into said substantially verticle bore hole until a lower end comes to rest against the bottom of said substantially vertical bore hole;

placing a chisel collar on said bit, said chisel collar has a coaxial guide pin for cooperation with an upper end of said pile; and ramming said pile deeper down into the ground by said drilling and piling rig using said drilling hammer, wherein said ramming step is performed without rotation.

2. The method of claim 1 wherein said pile comprises a sole pile in a pile foundation for said tubular foundation or a bottom pile in a column of substantially aligned piles in a pile foundation.

3. The method of claim 1 further comprising the steps of:

joining one or more second piles to said pile before said ramming step; and mutually ramming down said one or more second piles until the upper end of the uppermost pile is approximately at the level of the bottom of the bore hole for said tubular foundation.

4. A mobile combined drilling and piling machine comprising:

a motor-driven vehicle carrying a pivotable support arm;

a drilling and piling rig disposed on said pivotable support arm, said drilling and piling rig including a bit and a drilling hammer, said bit being attached to a lower end of said drilling hammer; and a chisel collar adapted to surround a lower part of said bit when said drilling hammer of said drilling and piling rig is to be used for non-rotating piling purposes, wherein said chisel collar has a coaxial guide pin for cooperation with an upper end of a pile.

* * * * *